US012698690B1

(12) United States Patent
Yarnold et al.

(10) Patent No.: US 12,698,690 B1
(45) Date of Patent: Aug. 4, 2026

(54) MODULAR SUBSEA CONTROL SYSTEM

(71) Applicant: OneSubsea IP UK Limited, London (GB)

(72) Inventors: Jonathan Yarnold, Houston, TX (US); Ronald James Spencer, Houston, TX (US); Shilpa Joshi, Houston, TX (US); Mahesh Shenoy, Houston, TX (US); Sonia Surmacz, Houston, TX (US); Hemra Esenyyazov, Houston, TX (US); Craig Agar, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 19/255,410

(22) Filed: Jun. 30, 2025

(51) Int. Cl.

| | |
|---|---|
| ***E21B 33/035*** | (2006.01) |
| ***E21B 34/04*** | (2006.01) |
| ***E21B 47/001*** | (2012.01) |
| ***E21B 47/07*** | (2012.01) |
| ***E21B 47/10*** | (2012.01) |

(52) U.S. Cl.
CPC ..... *E21B 33/0355* (2013.01); *E21B 34/04* (2013.01); *E21B 47/001* (2020.05); *E21B 47/07* (2020.05); *E21B 47/10* (2013.01)

(58) Field of Classification Search
CPC .... E21B 33/0355; E21B 34/04; E21B 47/001; E21B 47/07; E21B 47/10
See application file for complete search history.

(56) References Cited

U.S. PATENT DOCUMENTS

| | | | | |
|---|---|---|---|---|
| 3,894,560 | A * | 7/1975 | Baugh | E21B 33/0355 166/368 |
| 9,291,020 | B2 * | 3/2016 | McWhorter | E21B 33/038 |
| 2009/0194290 | A1 * | 8/2009 | Parks | E21B 33/0355 166/344 |
| 2012/0111572 | A1 * | 5/2012 | Cargol, Jr. | E21B 33/0355 166/363 |
| 2012/0132436 | A1 * | 5/2012 | Judge | E21B 33/076 166/363 |
| 2017/0198542 | A1 * | 7/2017 | Dailey, Jr. | E21B 41/0007 |

FOREIGN PATENT DOCUMENTS

| | | | | |
|---|---|---|---|---|
| WO | WO-2014074747 | A1 * | 5/2014 | E21B 33/063 |

* cited by examiner

*Primary Examiner* — James G Sayre
(74) *Attorney, Agent, or Firm* — Kyle R. Miiller

(57) ABSTRACT

A modular control system for a mineral extraction system includes a first control module positioned at a first location within a riser of the mineral extraction system and a second control module positioned at a second location within the riser closer to a wellhead of the mineral extraction system than the first location. The first control module includes a first electronics module configured to output and receive control signals, an energy storage unit, and a hydraulics system configured to generate a flow of pressurized fluid. The second control module includes a second electronics module communicatively coupled to the first electronics module and configured to output and receive additional control signals, and valves communicatively coupled to the second electronics module, fluidly coupled to the hydraulics system, and configured to adjust operations of the mineral extraction system.

15 Claims, 4 Drawing Sheets

MODULAR SUBSEA CONTROL SYSTEM

BACKGROUND

The present disclosure relates generally to a modular subsea control system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Fluids (e.g., hydrocarbons such as oil and natural gas) may be extracted from subsurface reservoirs and transported to the surface for commercial sale, such as for use in the power industry, transportation industry, manufacturing industry, and other applicable industries. For example, a well may be drilled into the ground to a subsurface reservoir, and equipment may be installed in the well and on the surface to facilitate extraction of the fluids. In some cases, the wells may be offshore (e.g., subsea), and the equipment may be disposed underwater, on offshore platforms, and/or on floating systems.

Subsea mineral extraction systems (e.g., subsea systems) may include an offshore vessel or platform at a surface and a riser extending from the offshore vessel to a subsea wellhead. During certain operations, equipment (e.g., subsea test tree, tubing hanger) may be lowered into and installed within the riser to configure, test, and/or operate the mineral extraction system (e.g., extract fluid from and/or inject fluid into the well). In certain mineral extraction systems, a control system is positioned within the riser to control operations of the equipment. For example, a control system may be positioned above a blowout preventer (BOP). The control system may be configured to control equipment (e.g., subsea test tree, tubing hanger, etc.) within the riser by controlling a flow of hydraulic fluid from the control system to respective devices (e.g., valves, locking mechanisms, etc.). When the control system is disposed above the BOP, response times associated with controlling certain devices may be slower than desired due to a separation distance between the control system and the equipment. In addition, the size (e.g., length) and/or positioning of the control system within the riser may lead to lengthy installation times, as equipment may be tested and lowered into the riser sequentially.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In certain embodiments, a modular control system for a mineral extraction system includes a first control module configured to be positioned at a first location within a riser of the mineral extraction system. The first control module includes a first electronics module configured to output and receive control signals, an energy storage unit, and a hydraulics system configured to generate a flow of pressurized fluid. Additionally, the modular control system includes a second control module configured to be positioned at a second location within the riser, where the second location is closer to a wellhead of the mineral extraction system than the first location. The second control module includes a second electronics module configured to output and receive additional control signals, where the second electronics module is communicatively coupled to the first electronics module. Further, the second control module includes a plurality of valves configured to adjust operations of the mineral extraction system. The plurality of valves is communicatively coupled to the second electronics module, fluidly coupled to the hydraulics system, and configured to control the flow of pressurized fluid to adjust operations of the mineral extraction system.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
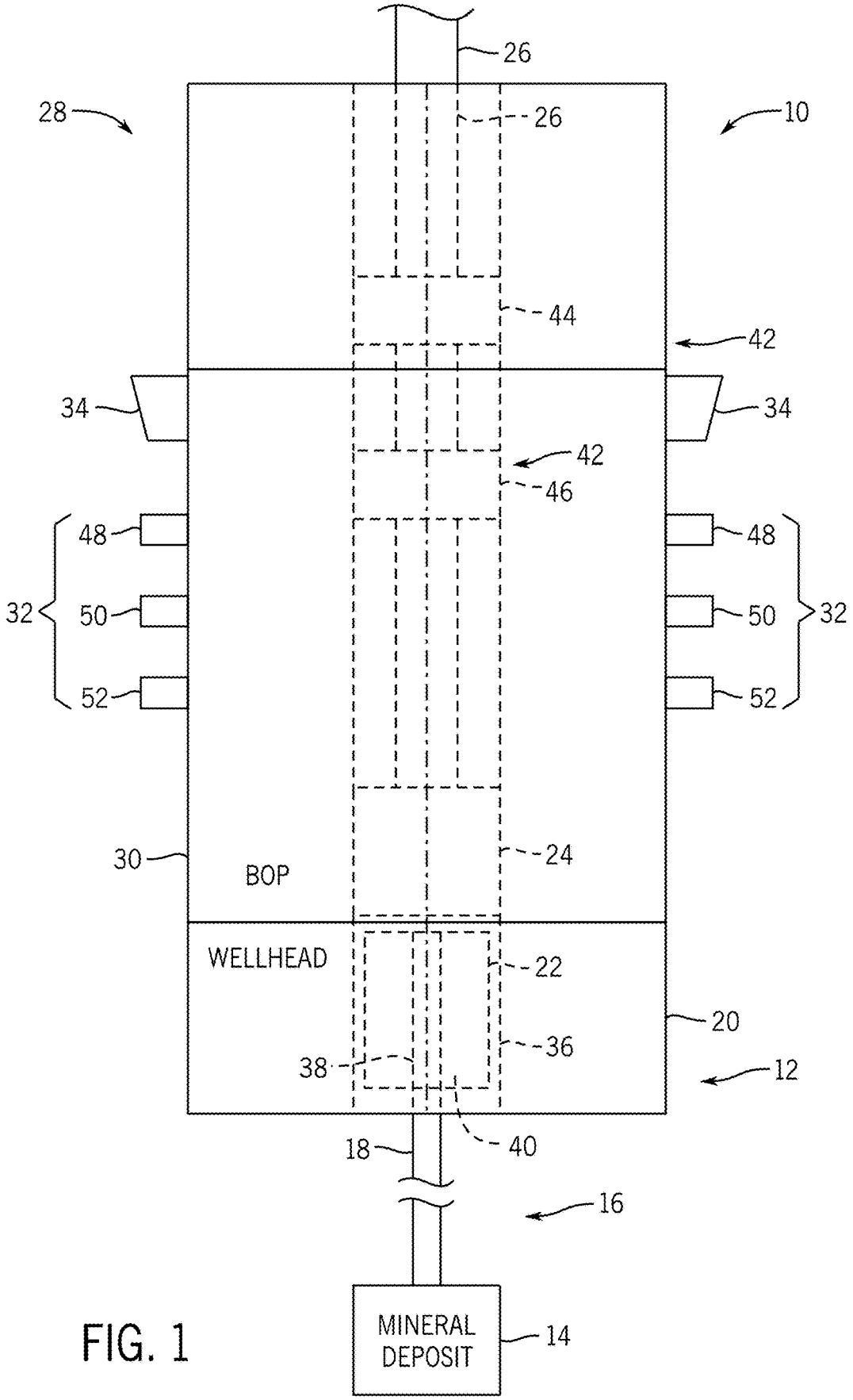
FIG. 1 is a block diagram of an embodiment of a mineral extraction system.

Specific embodiments of the present disclosure are described below. To provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

A mineral extraction system (e.g., subsea system) may include an in-riser control system to control equipment within the riser of the mineral extraction system. The in-riser control system may control a flow of hydraulic fluid from the control system to respective devices positioned within the riser, thereby controlling operation of the respective devices. Unfortunately, it may be challenging to effectively position the in-riser control system within the riser. For example, blow out preventers (BOPs) may include a number of valves, fittings, and controls, such as rams (e.g., shear rams, blind rams) and annular sealing devices (e.g., packers, doughnuts), that may limit an amount of space within the BOP that may accommodate an in-riser control system. Additionally, positioning the in-riser control system above the BOP may lead to slower than desired response times associated with controlling the respective devices due to the separation distance between the in-riser control system and the respective devices. Further, a size (e.g., length) and/or positioning of the in-riser control system within the riser may lead to lengthy installation times, as equipment may be tested and lowered into the riser sequentially (e.g., portion by portion) and/or multiple times (e.g., certain components of the mineral extraction system may be tested and lowered into the riser multiple times as additional components are installed in order to test the connections between different components).

Therefore, embodiments of the present disclosure are directed toward a modular subsea control system for a mineral extraction system. The modular subsea control system may include multiple subsea control modules (SCMs) positioned at different locations within a riser of the mineral extraction system. For example, the modular subsea control system may include a first subsea control module positioned at a first location along the length of the riser, and a second subsea control module positioned at a second, different location along the length of the riser. The first subsea control module and the second subsea control module may include different components of the control system. The first SCM may include an electronics module (e.g., first electronics module), an energy storage unit (e.g., including batteries), and a hydraulics system (e.g., including one or more reservoirs, one or more hydraulic pump units, one or more accumulators, one or more intensifiers). The second SCM may include an additional electronics module (e.g., second electronics module), valves (e.g., directional control valves, solenoid valves), flow meters, and gauges (e.g., pressure and/or temperature gauges). The modular subsea control system is configured to monitor and control equipment of the mineral extraction system (e.g., a subsea test tree, a partial subsea test tree, a tubing hanger running tool, completion equipment, etc.).

During operation, the first SCM may receive power and communications from an offshore vessel or platform of the mineral extraction system (e.g., from a topside control system), and may distribute or relay a portion of the power and/or communications to the second SCM. The second SCM may receive power and communications (e.g., control signals) from the first SCM, and the electronics module within the second SCM may control the valves within the second SCM based on the communications. The valves may control flow of pressurized fluid from the hydraulics system of the first SCM to actuators within equipment of the mineral extraction system, thereby controlling the equipment of the mineral extraction system. Further, the second SCM may measure flow parameters of the wellhead (e.g., via the flow meters and/or the gauges) and may output data indicative of the measured flow parameters to the first SCM, which may, in turn, output the data to the surface (e.g., to a topside control system).

In certain embodiments, the first SCM may be positioned above a BOP (e.g., above an annular sealing device of the BOP) and the second SCM may be positioned within the BOP (e.g., below the annular sealing device of the BOP, in a space between two rows of rams of the BOP, etc.). Additionally, or alternatively, the first SCM may be positioned at a first location within the BOP (e.g., below the annular sealing device) and the second SCM may be positioned at a second location within the BOP (e.g., below the first SCM and in a space between two rows of rams). The first SCM and the second SCM may be electrically, communicatively, and fluidly coupled to one another via lines (e.g., cables, conduits) extending between the modules. In certain embodiments, power cables (e.g., electric lines), communication cables (e.g., data lines), and fluid conduits (e.g., hydraulic lines) coupling the first SCM and the second SCM may run through longitudinal passages within a slick joint between the first SCM and the second SCM. Accordingly, the slick joint may protect the lines coupling the first SCM and the second SCM from components (e.g., rams) of the BOP.

Positioning the second SCM within the BOP may improve (e.g., reduce) response times associated with controlling equipment of the mineral extraction system, as the distance between the control system and the equipment being controlled is reduced. Further, distributing the control system into separate modules may shorten a total length of an assembly (e.g., string) of equipment within the riser, as at least a portion of the control system is moved within the BOP. Accordingly, the assembly may be tested and lowered within the riser at the same time, rather than in sections, thereby reducing the installation time of the assembly. Additionally, the mineral extraction system may not include an umbilical (e.g., power, communication, and hydraulic lines) extending between the vessel or platform and the modular subsea control system to provide power, communication data, and fluid to the modular subsea control system, because the modular subsea control system includes a power storage unit, electronics modules, and a hydraulic system that may be used to control the equipment. Therefore, the modular subsea control system may improve performance (e.g., improve response times associated with controlling equipment), improve flexibility, and reduce costs (e.g., by reducing installation times) of the mineral extraction system (e.g., as compared to a mineral extraction system having a control system positioned entirely above the BOP and/or using an umbilical).

With the foregoing in mind, FIG. 1 is a block diagram of an embodiment of a mineral extraction system 10. The mineral extraction system 10 may be configured to extract various minerals and natural resources, including hydrocarbons (e.g., oil and/or natural gas) from the earth, and/or the mineral extraction system may be configured to inject substances into the earth. In some embodiments, the mineral extraction system 10 is subsea (e.g., a subsea system). As illustrated, the mineral extraction system 10 includes a wellhead system 12 coupled to a mineral deposit 14 via a well 16 having a well-bore 18.

In the illustrated embodiment, the wellhead system 12 includes a wellhead 20 and a tubing hanger 22 disposed within the wellhead 20. The mineral extraction system 10 may include other device(s) that are coupled to the wellhead system 12 and/or device(s) that are used to assemble various components of the wellhead system 12. For example, in the illustrated embodiment, the mineral extraction system 10 includes a tubing hanger running tool (THRT) 24 suspended from a drilling string 26. In certain embodiments, the tubing hanger 22 supports tubing (e.g., a tubing/landing string). During a running or lowering process, the THRT 24 is coupled to the tubing hanger 22, thereby coupling the tubing hanger 22 to the drilling string 26. The THRT 24, which is coupled to the tubing hanger 22, is lowered (e.g., run) from an offshore vessel to the wellhead 20 (e.g., through a riser 28 extending between the offshore vessel and the wellhead 20). Once the tubing hanger 22 has been lowered into a landed position within the wellhead 20, the tubing hanger 22 may be permanently locked into position. The THRT 24 may then be uncoupled from the tubing hanger 22 and extracted from the wellhead system 12 by the drilling string 26.

In the illustrated embodiment, the riser 28 includes a blowout preventer (BOP) 30. The BOP 30 may include a variety of valves, fittings, and controls to block oil, gas, or other fluid from exiting the well in the event of an unintentional release of pressure or an overpressure condition. For example, the BOP 30 may include a number of rams 32 (e.g., pipe rams, blind rams, shear rams, blind shear rams, etc.) and an annular sealing device 34 disposed at or near a top end of the BOP 30 (e.g., an end furthest from the wellhead 20). While the BOP 30 includes three sets or rows of rams 32 in the illustrated embodiment, in other embodiments, the BOP 30 may have fewer or more sets of rams 32 (e.g., 0, 1, 2, 4, 5, etc.). Furthermore, the wellhead 20 has a bore 36, which may provide access to the well-bore 18 for various completion and workover procedures. For example, components may be run down to the wellhead system 12 and disposed in the wellhead bore 36 to seal-off the well-bore 18, to inject chemicals down-hole, to suspend tools down-hole, to retrieve tools, and the like. The rams 32 of the BOP 30 may be adjusted or controlled to extend inwardly to restrict a flow of fluid exiting the well, and the rams 32 may fully seal the well in the event of an unintentional release of pressure or an overpressure condition (e.g., opposing rams of each set of rams 32 may move toward each other and seal the well). Additionally, the rams 32 may be adjusted or controlled to retract to increase a flow of fluid exiting the well, and may unseal the well when the overpressure condition is resolved (e.g., opposing rams of each set of rams 32 may move away from each other to unseal the well). Likewise, in the event of an unintentional release of pressure or an overpressure condition, the annular sealing device 34 may be controlled or adjusted to close to block fluid flow, and/or when the event is resolved, the annular sealing device 34 may be controlled or adjusted to open to enable fluid flow.

The well-bore 18 may contain elevated fluid pressures. For example, pressures within the well-bore 18 may exceed 10,000 pounds per square inch (PSI), 15,000 PSI, or 20,000 PSI. Accordingly, the mineral extraction system 10 may employ various mechanisms, such as mandrels, seals, plugs, and valves, to control the well 16. For example, the illustrated tubing hanger 22 may be disposed within the wellhead 20 to secure tubing suspended in the well-bore 18, and to provide a path for hydraulic control fluid, chemical injection, electrical connection(s), fiber optic connection(s), and the like. The tubing hanger 22 includes a central bore 38 that extends through the center of a body 40 of the tubing hanger 22, and the central bore 38 is in fluid communication with the well-bore 18. The central bore 38 is configured to facilitate flow of hydrocarbons through the body 40 of the tubing hanger 22.

In the illustrated embodiment, the mineral extraction system 10 includes a modular subsea control system 42 configured to control multiple devices (e.g., locking mechanism(s), actuator(s), etc.) within the riser 28 of the mineral extraction system 10 (e.g., during a landing string running process, during a testing operation of the mineral extraction system 10, etc.). For example, the modular subsea control system 42 may control a position and/or orientation (e.g., angular position) of the THRT 24 during the running or lowering process of the tubing hanger 22 described above. Additionally, the modular subsea control system 42 may control and adjust operations of the tubing hanger 22 as well as devices coupled to the tubing hanger 22 (e.g., test tree). The modular subsea control system 42 includes a first subsea control module (SCM) 44 positioned above the BOP 30 (e.g., above the annular sealing device 34) and a second SCM 46 positioned within the BOP 30 (e.g., in a space between the annular sealing device 34 and a first row or set of rams 32). As discussed in detail below, the first SCM 44 is configured to receive power and communications (e.g., control signals, communication data) from the offshore vessel (e.g., via a topside control system). Further, the first SCM 44 is configured to direct or relay a portion of the power and communications to the second SCM 46. Additionally, the first SCM 44 is configured to direct pressurized fluid to the second SCM 46, and the second SCM 46 is configured to control flow of the pressurized fluid to actuators within equipment of the mineral extraction system 10 (e.g., THRT 24, subsea test tree, partial subsea test tree, completion equipment, etc.). For example, an electronics module of the second SCM 46 may receive communications from the first SCM 44, and the electronics module may control valves of the second SCM 46 based on the communications to control flow of the pressurized fluid to the actuators of the equipment, thereby controlling the equipment. The second SCM 46 is configured to measure flow parameters of fluid within the well 16 (e.g., downhole pressure, downhole temperature, etc.) and output data indicative of the flow parameters to the first SCM 44, which may output the data to the offshore vessel (e.g., to a topside control system). Accordingly, the modular subsea control system 42 may control operations of equipment within the riser 28 of the mineral extraction system 10 and may monitor parameters of the well 16.

While the first SCM 44 is positioned above the annular sealing device 34 of the BOP 30 and the second SCM 46 is positioned below the annular sealing device 34 of the BOP 30 in the illustrated embodiment, in certain embodiments, the first SCM 44 and the second SCM 46 may be positioned within the BOP 30. For example, the first SCM 44 may be positioned below the annular sealing device 34 of the BOP 30 and above a first set of rams 48, and the second SCM 46 may be positioned in a space between the first set of rams 48 and a second set of rams 50, or in a space between the second set of rams 50 and a third set of rams 52. Accordingly, the first SCM 44 and the second SCM 46 may be positioned at different locations within the riser 28, with the first SCM 44 positioned at a height above the second SCM 46 (e.g., at a location within the riser 28 farther from the wellhead 20) and at least one of the first SCM 44 or the second SCM 46 positioned in a dead space within the BOP 30 (e.g., in a space between components of the BOP 30).

Positioning at least one of the control modules of the modular subsea control system 42 (e.g., the first SCM 44 and/or the second SCM 46) within the BOP 30 may improve (e.g., reduce) response times associated with controlling equipment of the mineral extraction system 10 (e.g., THRT 24, subsea test tree, partial subsea test tree, completion equipment, etc.), because the distance between the modular subsea control system 42 and the equipment being controlled is reduced (e.g., compared to a control system disposed entirely above the BOP 30). Further, the modular subsea control system 42 may shorten a total length of an assembly (e.g., string) of equipment within the riser 28, as at least a portion of the modular subsea control system 42 is within the BOP 30. Accordingly, the assembly of equipment may be tested and lowered within the riser 28 at the same time, rather than in sections, thereby reducing an installation time associated with the assembly. Additionally, the mineral extraction system 10 may not include an umbilical (e.g., power, communication, and hydraulic lines) extending between the offshore vessel and the modular subsea control system 42 to provide power, communication data, and fluid to the modular subsea control system 42, because the modular subsea control system 42 includes a power storage unit, electronics modules, and a hydraulic system that may be used to control the equipment. Therefore, the modular subsea control system 42 may improve performance (e.g., reduce response times associated with controlling equipment), improve flexibility, and reduce costs (e.g., by reducing installation times) of the mineral extraction system 10 (e.g., as compared to a mineral extraction system having a control system positioned entirely above the BOP and/or using an umbilical).

Figure 2:
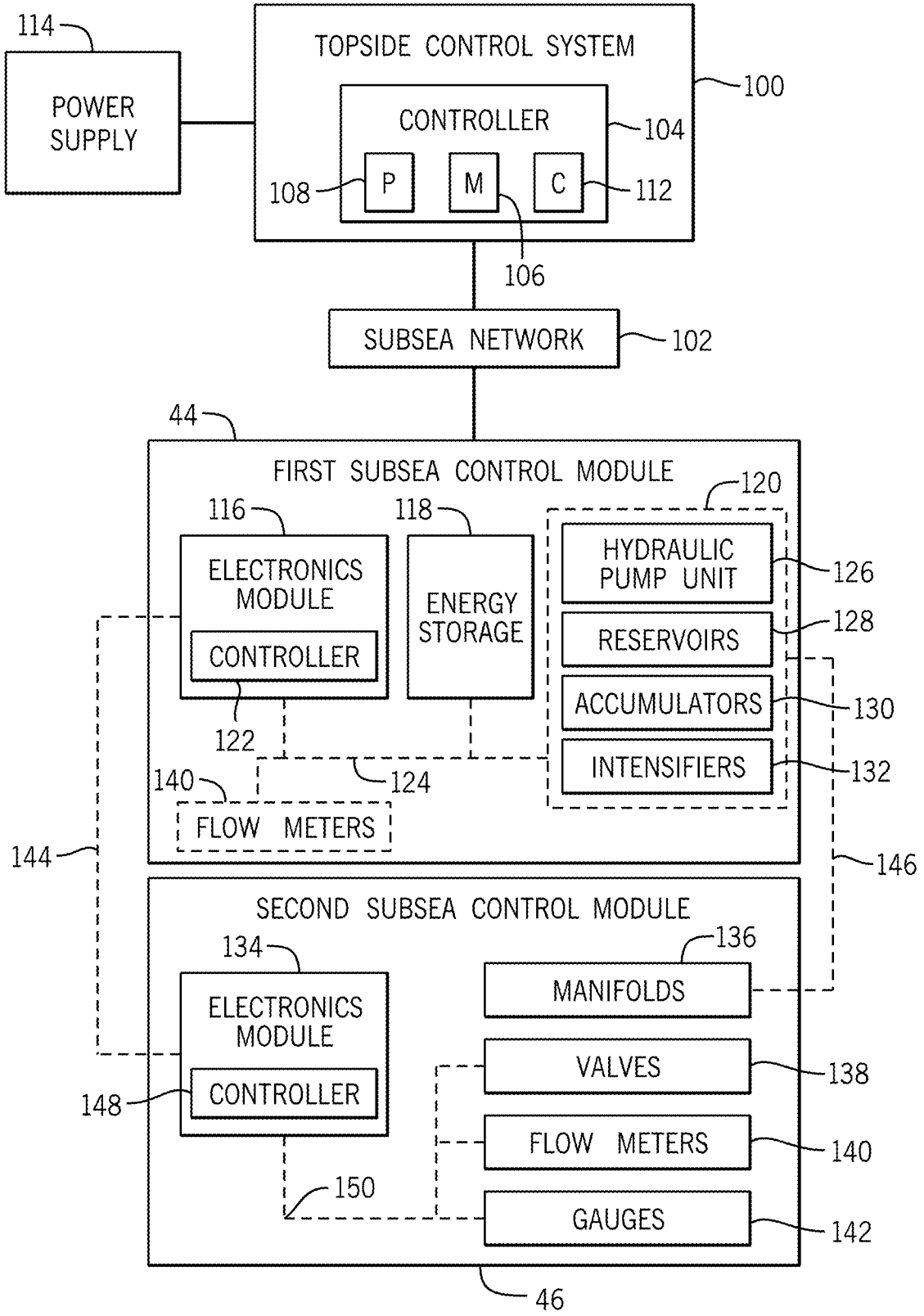
FIG. 2 is a block diagram of an embodiment of a modular subsea control system that may be employed in the mineral extraction system of FIG. 1.

FIG. 2 is a block diagram of an embodiment of a modular subsea control system 42 that may be employed within the mineral extraction system of FIG. 1. As previously discussed, the modular subsea control system 42 is configured to control multiple devices (e.g., locking mechanism(s), actuator(s), etc.) within the riser of the mineral extraction system. For example, the modular subsea control system 42 may control equipment of a well or landing string, completion equipment (e.g., equipment of a completion string), the THRT, a test tree (e.g., subsea test tree, partial subsea test tree), and the like, within the riser. In the illustrated embodiment, the modular subsea control system 42 includes a first subsea control module 44 and a second subsea control module 46. As discussed above, the first SCM 44 may be positioned at a first location within the riser (e.g., above the annular sealing device of the BOP) and the second SCM 46 may be positioned at a second location (e.g., below the annular sealing device of the BOP) within the riser at a position closer to the wellhead than the first SCM 44 (e.g., below the first SCM 44).

As shown in FIG. 2, the modular subsea control system 42 may be communicatively and electrically coupled to a topside control system 100 via a subsea network 102 (e.g., subsea communication distribution network, subsea power and communication distribution network). The subsea network 102 may include hardware and devices configured to facilitate data communication (e.g., control signals, messages, statuses) between the modular subsea control system 42 and the topside control system 100 without an umbilical (e.g., telecommunication cable) running between the topside control system 100 and the modular subsea control system 42. For example, the subsea network 102 may include a surface transceiver located near sea level and coupled to the topside control system 100 at the surface, a subsea transceiver located near the seabed and coupled to communication nodes on and/or within the riser 28 (e.g., a node coupled to the outside of the BOP 30, a node within the riser 28, communication circuitry within the first SCM 44 and/or second SCM 46, etc.), telemetry equipment, and any other suitable wireless telecommunication hardware. In certain embodiments, the subsea network 102 may include one or more electrical cables running between the topside control system 100 and the modular subsea control system 42 to electrically and communicatively couple the control systems and facilitate distributing power and control signals to the modular control system 42. In other embodiments, the one or more electrical cables may be omitted from the subsea network 102, and the modular control system 42 may self-power and power components of the mineral extraction system 10 without a flow of power from the surface. For example, the modular control system 42 may include one or more energy storage units, as discussed below. Additionally, the subsea network 102 may include hardware and devices configured to distribute power from the topside control system 100 to the modular subsea control system 42 without an umbilical (e.g., one or more electrical cables) running between the topside control system 100 and the modular subsea control system 42 (e.g., via in-riser power distribution hardware such as in-riser power lines, one or more busbars, bus ducts, bus rail support systems, components for inductive power transfer, etc.).

The topside control system 100 is configured to mount on a host structure associated with the mineral extraction system 10, such as a surface vessel, a platform, or a marine vessel on the surface of the water. The topside control system 100 includes a controller 104 having a memory 106, a processor 108, and communication circuitry 112. In certain embodiments, the topside control system 100 may be coupled with a power supply 114 to direct or supply power to the mineral extraction system 10 (e.g., to power the landing string, completion equipment, the modular control system 42, the BOP 30, installation equipment, testing equipment, etc.) via the one or more electrical cables of the subsea network 102. In certain embodiments, the power supply 114 may include multiple power sources and may encompass power received via wave energy power buoys, offshore wind turbines, and other electrical power sources.

The power supply 114 may include a power generation system, a power grid, or a combination thereof. For example, the power generation system may include one or more electrical generators driven by combustion engine(s), such as gas turbine engine(s) and/or reciprocating piston-cylinder engine(s). The power generation system may include one or more wind turbines, solar panels, hydro turbines, or other power sources. The power supply 114 is configured to provide power to components of the mineral extraction system (e.g., to power the landing string, completion equipment, the modular control system 42, the BOP 30, installation equipment, testing equipment, etc.) via control by the topside control system 100 (e.g., controller 104) and/or the modular subsea control system 42 and via distribution by the one or more electric cables of the subsea network 102. The topside control system 100 (e.g., controller 104) and/or the subsea control modules may be configured to control a flow of power (e.g., electric current) from the power supply 114 to components of the mineral extraction system for operating the components. In certain embodiments, the power supply 114 is configured to supply power to the components of the topside control system 100 (e.g., memory 106, a processor 108, and communication circuitry 112) without supplying power to components of the mineral extraction system (e.g., when the subsea network 102 is a wireless communication distribution network without the one or more electric cables). In such embodiments, the modular control system 42 may self-power and power components of the mineral extraction system without a flow of power from the power supply 114.

The first SCM 44 includes an electronics module (e.g., first electronics module) 116, an energy storage unit 118, and a hydraulics system 120. The electronics module 116 may include a controller 122 with a memory, a processor, and communication circuitry. During operations of the mineral extraction system, the electronics module 116 (e.g., controller 122) is configured to output and receive communication data (e.g., control signals) to/from the topside control system 100 and the second SCM 46 (e.g., via the subsea network 102 and/or the communication circuitry of the controller 122). Additionally, the electronics module 116 is configured to receive power from the energy storage unit 118 and direct power to components of the modular control system 42 (e.g., to the hydraulics system 120, to components of the second SCM 46) from the energy storage unit 118.

In certain embodiments, the electronics module 116 is also configured to receive power from the power supply 114 via the topside control system 100 and via the one or more electrical cables of the subsea network 102. For example, the topside control system 100 may continuously or intermittently control a flow of power from the power supply 114 to the first subsea control module 44. For example, the topside control system 100 may output power to the first SCM 44 during startup operations of the mineral extraction system, in response to user inputs (e.g., received via a user interface associated with the mineral extraction system), in response to control signals from the first SCM 44 requesting additional power, and the like. The electronics module 116 may regulate or direct the flow of power from the surface to components of the modular subsea control system 42. For example, the electronics module 116 may direct some or all of the flow of power to charge or recharge the energy storage unit 118.

The energy storage unit 118 may include a number of batteries (e.g., lithium-ion batteries, lithium-ion polymer batteries, lead-acid batteries, nickel-iron batteries, nickel-metal hydride batteries, or a combination thereof) configured to collectively or individually store an amount of power. For example, the energy storage unit 118 may be configured to store an amount of power associated with operating the modular subsea control system 42 and/or components of the mineral extraction system for a predetermined amount of time without additional power from the surface. As discussed above, in certain embodiments, the energy storage unit 118 may be configured to power components of the mineral extraction system without receiving power from the surface.

Further, the electronics module 116 may direct power to the hydraulics system 120 from the energy storage unit 118 and/or from the power supply 114. The electronics module 116 may be electronically and communicatively coupled to the energy storage unit 118 and the hydraulics system 120 via any suitable cables, lines, conduits, transceivers, and the like, as indicated by dashed lines 124. Accordingly, the electronics module 116 may output power and control signals to the energy storage unit 118 and the hydraulics system 120 to control operations thereof. The hydraulics system 120 is configured to output control fluid (e.g., pressurized fluid). In certain embodiments, the control fluid may include hydraulic fluid, pneumatic fluid (e.g., air), or a combination thereof. The hydraulics system 120 may provide control fluid (e.g., pressurized fluid) to various components of the mineral extraction system (e.g., via the second SCM 46). The hydraulics system 120 may include one or more pumps, one or more valves, one or more fluid conduits, one or more regulators, other suitable components, or a combination thereof. For example, the hydraulics system 120 may include one or more hydraulic pump units 126, one or more reservoirs 128, one or more accumulators 130, and one or more intensifiers 132. The hydraulic pump unit(s) 126 may be configured to pressurize the fluid. The reservoir(s) 128 may store a supply of unpressurized or unconditioned fluid for use within the hydraulic system 120. For example, the hydraulic pump unit(s) 126 may receive or draw fluid from the reservoir(s) 128. In addition, the fluid may vent or return back to the reservoir(s) 128 after the fluid has been used to control operations of one or more components of the mineral extraction system. The accumulator(s) may store a portion of the pressurized fluid within the hydraulics system 120 and may provide pressurized fluid to reduce pressure fluctuations and/or reduce demand on the hydraulic pump unit(s) 126. The intensifier(s) 132 may be used to increase the pressure of the fluid (e.g., from 2-5 ksi to 10 ksi). The pressurized fluid provided by the hydraulics system 120 may be used to control or adjust operations of various equipment of the mineral extraction system (e.g., the THRT, subsea test tree, etc.).

Additionally, the electronics module 116 of the first SCM 44 may direct power to the second SCM 46 from the energy storage unit 118 and/or from the power supply 114. The second SCM 46 includes an additional electronics module (e.g., second electronics module) 134, manifolds 136, valves 138 (e.g., direct control valves, proportional control valves, solenoid valves, etc.), flow meters 140, and pressure and/or temperature gauges 142. The first SCM 44 and the second SCM 46 may be electrically and communicatively coupled via one or more electric cables and telecommunication cables 144. Further, the first SCM 44 and the second SCM 46 may be fluidly coupled via one or more fluid conduits or hydraulic lines 146 extending between the hydraulics system 120 of the first SCM 44 and the manifolds 136 of the second SCM 46, thereby placing the hydraulic system 120 and the manifolds 136 in fluid communication with one another.

The additional electronics module 134 may include a controller 148 with a memory, a processor, and communication circuitry. During operations of the mineral extraction system, the additional electronics module 134 (e.g., controller 148) is configured to receive power and communication data (e.g., control signals) from the first SCM 44 (e.g., from the first electronics module 116 and via the one or more cables 144). The additional electronics module 134 may be electronically and communicatively coupled to the valves 138, the flow meters 140, and the gauges 142 via any suitable cables, lines, conduits, transceivers, and the like, as indicated by dashed line 150. Accordingly, the electronics module 116 and/or the additional electronics module 134 may distribute (e.g., control) a flow of power from the first SCM 44 to one or more components of the second SCM 46 (e.g., valves 138, flow meters 140, pressure and/or temperature gauges 142). The additional electronics module 134 may receive a control signal from the first electronics module 116, and may process the control signal (e.g., via the processor of the controller 148 executing additional software, etc.) to generate one or more additional control signals to adjust operations of components of the second SCM 46.

For example, the additional electronics module 134 may receive a control signal indicative of instructions for one or more valves 138 to control flow of the pressurized fluid from the hydraulic system 120 to one or more actuators of one or more devices (e.g., THRT, subsea test tree, etc.), and the additional electronics module 134 may control the valve(s) based on the instructions. Furthermore, the additional electronics module 134 may receive a control signal indicative of instructions to monitor one or more parameters, and the additional electronics module 134, in turn, may control the flow meters 140 and/or the gauges 142 to measure the one or more parameters (e.g., downhole pressure, downhole temperature, mass flow rate, etc.). The additional electronics module 134 may also relay the measured value(s) of the parameter(s) to the first electronics module 116. Additionally or alternatively, the flow meter 140 and/or the gauges 142 may continuously or periodically measure the one or more parameters (e.g., according to a sampling time interval), and the additional electronics module 134 may continuously or periodically output the measured value(s) of the parameter(s) to the first electronics module 116 of the first SCM 44, which may, in turn, output the measured value(s)

to the topside control system. The topside control system, the first electronics module 116, and/or the additional electronics module 134 may utilize the measured value(s) of the one or more parameters as inputs to one or more respective software models, simulations, control schemes, and the like, to control various components of the mineral extraction system (e.g., THRT, subsea test tree, etc.). Additionally, the topside control system may display the measured value(s), as well as generate notifications related to the measured value(s) (e.g., status update(s), alarm(s), maintenance request(s), etc.), via one or more user interfaces associated with the mineral extraction system for operator review and consideration.

The additional electronics module 134 and/or the electronics module 116 may execute commands to adjust operations of the valves 138 to control and adjust operations of various components of the mineral extraction system. For example, the electronics module 116 may execute commands to control the hydraulics system 120 to direct pressurized fluid to the second SCM 46. The manifold(s) 136 of the second SCM 46 may receive the pressurized fluid and direct the pressurized fluid to the valve(s) 138, and the additional electronics module 134 may control the valve(s) 138 to control flow of the pressurized fluid to one or more fluidly controlled actuators, thereby controlling respective device(s) (e.g., THRT, subsea test tree). For example, the valves 138 may be used to control THRT actuators to lock the tubing hanger into position within the wellhead. Additionally, the valves 138 may be used to control actuators within a test tree (e.g., subsea test tree, partial subsea test tree, etc.) and/or completion equipment coupled to the wellhead. Accordingly, the topside control system, the first SCM 44, and the second SCM 46 are configured to coordinate control of various components of the mineral extraction system. In certain embodiments, the hydraulics system 120 may continuously output pressurized fluid to the manifolds 136 (e.g., without direct control from the electronics module 116), such that pressurized fluid is continuously supplied to the valves 138.

While the second SCM 46 includes the additional electronics module 134 in the illustrated embodiment, in certain embodiments, the additional electronics module 134 may be omitted from the second SCM 46. For example, valves 138, flow meters 140, and gauges 142 may be directly communicatively coupled to and controlled by the electronics module 116 within the first SCM 44 (e.g., via any suitable cables, lines, conduits, etc.). Additionally, while the second SCM 46 includes the flow meters 140 in the illustrated embodiment, in certain embodiments, the first SCM 44 may include the flow meters 140 rather than or in addition to the second SCM 46, as shown in dotted lines. In such embodiments, the first electronics module 116 may continuously or periodically receive the measured value(s) of the parameter(s) from the flow meters 140 and output the measured value(s) of the parameter(s) to the topside control system 100.

Figure 3:
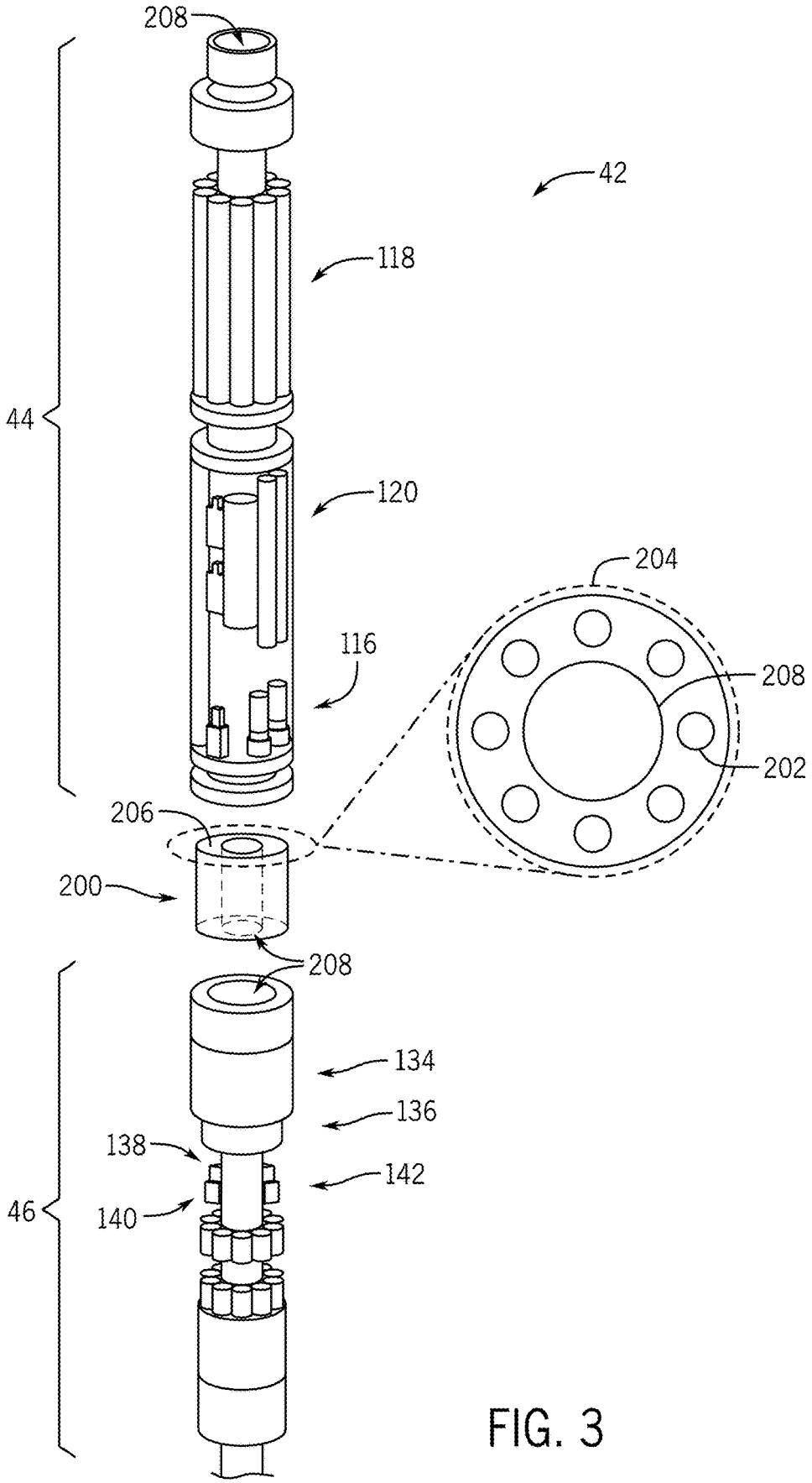
FIG. 3 is a perspective view of the modular subsea control system of FIG. 2.

FIG. 3 is a perspective view of the modular subsea control system 42 of FIG. 2, including the first SCM 44 and the second SCM 46. The first SCM 44 and the second SCM 46 include the components discussed above with respect to FIG. 2. As illustrated, the first SCM 44 includes the first electronics module 116, the energy storage unit 118, and the hydraulics system 120, and the second SCM 46 includes the second electronics module 134, the manifolds 136, the valves 138, the flow meters 140, and the gauges 142. As discussed above, the first SCM 44 and the second SCM 46 are separate and distinct components of the modular subsea control system 42, which are positioned in different locations within the riser of the mineral extraction system. At least one of the first SCM 44 and the second SCM 46 is positioned within the BOP of the mineral extraction system (e.g., below the annular sealing device, in a space between a set of rams, etc.).

The modular subsea control system 42 includes a slick joint 200 positioned in the riser between the first SCM 44 and the second SCM 46. The slick joint 200 is coupled to the first SCM 44 and to the second SCM 46, and the slick joint 200 may include a number of longitudinal passages 202 extending therethrough (e.g., circumferentially distributed around the slick joint 200), as shown in a detailed view 204 of a top end or face 206 of the slick joint 200. Each of the longitudinal passages 202 may be configured to receive and house one or more lines, conduits, cables, and the like, coupling the first SCM 44 and the second SCM 46. For example, a first subset of the longitudinal passages 202 may house electric cables electronically coupling the first SCM 44 and the second SCM 46, a second subset of the longitudinal passages 202 may house telecommunication cables communicatively coupling the first SCM 44 and the second SCM 46, and a third subset of the longitudinal passages 202 may house hydraulic lines fluidly coupling the first SCM 44 and the second SCM 46. Accordingly, the lines and conduits coupling the first SCM 44 and the second SCM 46 may extend through and be protected by the slick joint 200 (e.g., from contact with the rams and the annular sealing device of the BOP). The first SCM 44, second SCM 46, and slick joint 200 include a central passage 208 extending longitudinally therethrough that facilitates fluid flow into and out of the well of the mineral extraction system. The central passage 208 may be fluidly coupled to the tubing hanger and equipment coupled to the tubing hanger (e.g., test tree). Accordingly, fluid may flow through the central passage 208 when fluid is injected into and/or extracted from the well.

Figure 4:
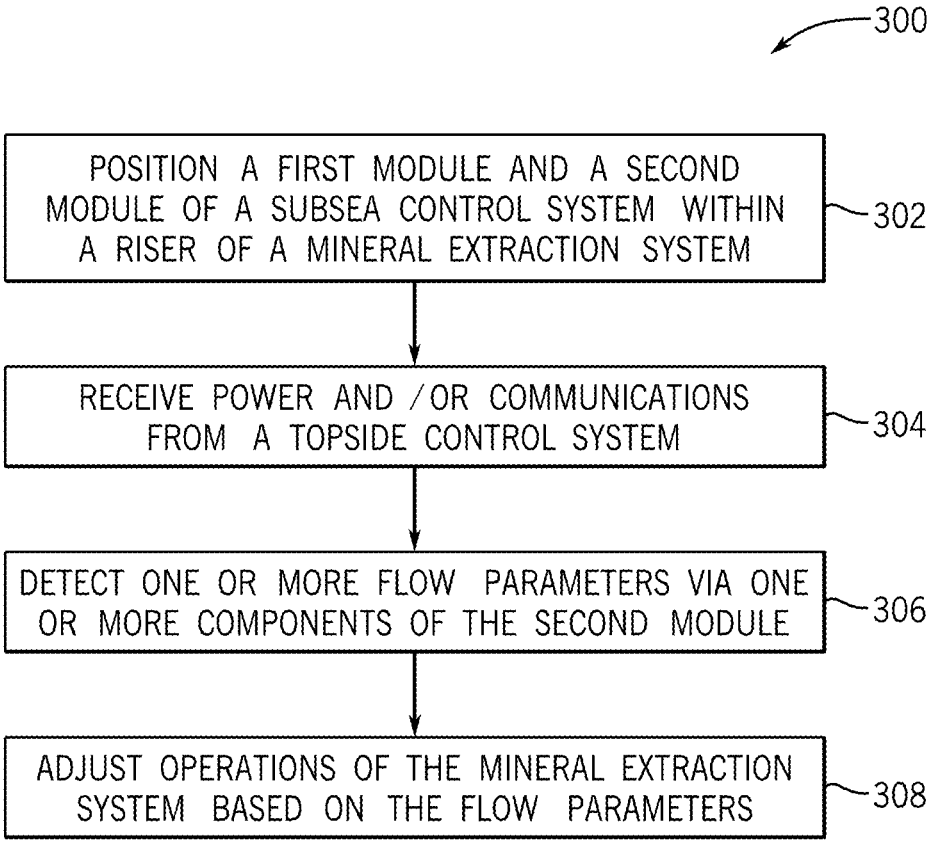
FIG. 4 is a flow diagram of an embodiment of a method for operating the modular subsea control system of FIG. 2.

With the foregoing in mind, FIG. 4 is a flow diagram of an embodiment of a process 300 for operating the modular subsea control system 42 of the mineral extraction system 10, in accordance with embodiments described herein. Although the steps of the process 300 are described as being performed in a particular order, which represents a particular embodiment, it should be noted that the process 300 may be performed in any suitable order. Moreover, although the following process is described as being performed within the mineral extraction system, it should be noted that the process 300 may be performed within any suitable mineral extraction system utilizing a remote, in-riser control system.

At block 302, a first module of a modular subsea control system 42 and a second module of the modular subsea control system 42 may be positioned within a riser 28 of a mineral extraction system 10. For example, the second subsea control module (SCM) 46 described above may be lowered into the riser 28 via a drill string 26 of the mineral extraction system 10 and positioned within a blowout preventer (BOP) 30. The second SCM 46 may be positioned below an annular sealing device 34 of the BOP and/or in a space between rams 32 of the BOP 30 (e.g., in a space between a first set of rams 48 and a second set of rams 50, in a space between the second set of rams 50 and a third set of rams 52). Additionally, the first subsea control module (SCM) 44 described above may be lowered into the riser 28 via the drill string 26. The first SCM 44 may be positioned within the riser 28 at a location separate from and above the second SCM 46 (e.g., at a location closer to the surface of the sea and farther from the wellhead 20 than the second SCM 46). For example, the first SCM 44 may be positioned above the annular sealing device 34 of the BOP 30. Additionally or alternatively, the first SCM 44 may be positioned below the annular sealing device 34 or in a space between rams 32 of the BOP 30 (e.g., in a space between the first set of rams 48 and the second set of rams 50). The first SCM 44 and the second SCM 46 of the modular subsea control system 42 may be electrically and communicatively coupled to a topside control system 100 of the mineral extraction system 10 (once positioned within the riser 28).

At block 304, the modular subsea control system 42 may receive power and/or communications from the topside control system 100. For example, as described above, the first SCM 44 may receive a flow of power from a power supply 114 via the topside control system 100 (e.g., controller 104) and via one or more electrical cables of a subsea network 102. The electronics module 116 of the first SCM 44 may direct at least a portion of the power from the surface to charge or recharge the energy storage unit 118 (e.g., batteries) of the first SCM 44. Further, the first SCM 44 may direct power (e.g., a portion of power from the power supply 114, power from the energy storage unit 118) to the hydraulics system 120 to pressurize fluid (e.g., hydraulic fluid, pneumatic fluid, etc.). Additionally, the first SCM 44 may direct power to the second SCM 46 to power components, such as the additional electronics module 134, the valves 138, the flow meters 140, and the gauges 142. The first SCM 44 may also receive control signals from the topside control system 100, such as commands to adjust charging protocols for the energy storage unit 118, and commands to relay to the second SCM 46, such as requests for data related to one or more flow parameters of the wellhead 20 and/or well 16 of the mineral extraction system 10. As discussed above, in certain embodiments, the subsea network 102 may be a wireless communication distribution network without the one or more electrical cables, and the energy storage unit 118 of the first SCM 44 may be configured to power components of mineral extraction system 10 without a flow of power form an external power supply. In such embodiments, the first SCM 44 may receive control signals from the topside control system 100 without receiving a flow of power, and the electronics module 116 of the first SCM 44 may direct power from the energy storage unit 118 to the hydraulics system 120 of the first SCM 44 and to the second SCM 46.

At block 306, the modular subsea control system 42 may detect values of one or more parameters of the wellhead 20 and/or the well. For example, the first electronics module 116 of the first SCM 44 and/or the additional electronics module 134 of the second SCM 46 may direct power to one or more flow meters 140 and one or more gauges 142 within the second SCM 46 to enable the flow meter(s) and/or gauge(s) to detect and measure one or more parameters. The flow meter(s) 140 monitors downhole fluid flow, and/or the gauge(s) 142 monitor downhole pressure, downhole temperature, and the like, and the flow meter(s) and/or the gauge(s) output signal(s) to the electronics module(s) indicative of measured value(s) of the monitored parameter(s). Additionally, or alternatively, the first electronics module 116 of the first SCM 44 may direct power to one or more flow meters 140 within the first SCM 44 to enable the flow meter(s) to detect and measure one or more parameters. Thus, the modular subsea control system 42 may include one or more monitoring devices communicatively coupled to the first electronics module 116 of the first SCM 44 or the additional electronics module 134 of the second SCM 46, and may detect values of one or more parameters of the wellhead 20 and/or well via the one or more monitoring devices (e.g., flow meters 140, gauges 142).

At block 308, the modular subsea control system 42 may adjust operations of the mineral extraction system 10 based on the monitored parameter(s). For example, the second SCM 46 and/or the first SCM 44 may output data indicative of measured value(s) of the detected parameter(s) to the topside control system 100. The topside control system 100 may display the measured value(s) of the detected parameter(s) to an operator of the mineral extraction system 10 (e.g., via a user interface) and may receive user inputs indicative of one or more commands to adjust operations of the mineral extraction system 10. Additionally or alternatively, the first SCM 44, the second SCM 46, and/or the topside control system 100 may utilize the monitored parameter(s) as input(s) to one or more control algorithms, software modules, simulations, and the like, to automatically generate one or more commands to adjust operations of the mineral extraction system 10. The first SCM 44 and the second SCM 46 may then control operations of various components within the mineral extraction system 10 based on the user input and/or automatically generated commands. For example, the hydraulic system 120 of the first SCM 44 may output a flow of pressurized fluid to the second SCM 46 via one or more fluid conduits or hydraulic lines fluidly coupling the first SCM 44 and the second SCM 46. The second SCM 46 may receive the flow of the pressurized fluid via the manifold(s) 136, and the additional electronics module 134 may control the valve(s) 138 to control flow of the pressurized fluid to one or more actuators, thereby controlling one or more respective components of the mineral extraction system 10. For example, actuating the valves 138 may control a locking system of the THRT 24 within the riser 28. Additionally, actuating the valves 138 may control actuators within a test tree (e.g., subsea test tree, partial subsea test tree) or completion equipment of the mineral extraction system 10. Therefore, the modular subsea control system 42 may control and adjust landing, testing, and completion operations of the mineral extraction system 10.

Technical effects of the disclosure include decreasing the installation time and response time associated with controlling devices within a riser of a mineral extraction system. Positioning at least one control module of a modular subsea control system within a blowout preventer (BOP) (e.g., beneath an annular sealing device, in a space between rams, etc.) may improve (e.g., reduce) response times associated with controlling equipment of the mineral extraction system, because the distance between the modular subsea control system and the devices being controlled is reduced compared to a control system disposed entirely above the BOP. Further, the modular subsea control system may shorten a length of an assembly (e.g., string) of equipment within the riser, as at least a portion of the modular subsea control system is within the BOP, rather than taking up dedicated space along the string above the BOP. Accordingly, the assembly of equipment may be tested and lowered within the riser at the same time, rather than in sections, thereby reducing an installation time associated with the assembly. Additionally, the mineral extraction system may not include an umbilical (e.g., power, communication, and hydraulic lines) extending between an offshore vessel of the mineral extraction system and the modular subsea control system to provide power, data, and fluid to the modular subsea control system, because the modular subsea control system includes a power storage unit, electronics modules, and a hydraulic system that may be used to control the devices. Therefore, the modular subsea control system may improve performance (e.g., reduce response times associated with controlling equipment), improve flexibility, and reduce costs (e.g., by reducing installation times) associated with the mineral extraction system.

The subject matter described in detail above may be defined by one or more clauses, as set forth below.

A modular control system for a mineral extraction system including a first control module configured to be positioned at a first location within a riser of the mineral extraction system, where the first control module comprises a first electronics module configured to output and receive control signals, an energy storage unit, and a hydraulics system configured to generate a flow of pressurized fluid. The modular control system also includes a second control module configured to be positioned at a second location within the riser, where the second location is closer to a wellhead of the mineral extraction system than the first location. The second control module includes a second electronics module configured to output and receive additional control signals, where the second electronics module is communicatively coupled to the first electronics module, and a plurality of valves configured to adjust operations of the mineral extraction system. The plurality of valves is communicatively coupled to the second electronics module, fluidly coupled to the hydraulics system, and configured to control the flow of the pressurized fluid to adjust operations of the mineral extraction system.

The modular control system of the preceding clause, wherein the first electronics module and the second electronics module are communicatively coupled to one another via one or more electric cables, and the hydraulics system is fluidly coupled to the plurality of valves via one or more hydraulic lines.

The modular control system of the preceding clause, comprising a slick joint disposed between the first control module and the second control module, wherein the one or more electric cables and the one or more hydraulic lines extend through one or more longitudinal passages within the slick joint.

The modular control system of any preceding clause, wherein the first location is above an annular sealing device of a blowout preventer, and the second location is below the annular sealing device.

The modular control system of any preceding clause, wherein the first location is below an annular sealing device of a blowout preventer, and the second location is in a space between a first set of rams of the blowout preventer and a second set of rams of the blowout preventer.

The modular control system of any preceding clause, wherein the first electronics module is configured to charge the energy storage unit by controlling a flow of power from a power supply configured to mount to a host structure associated with the mineral extraction system.

The modular control system of the preceding clause, wherein the first electronics module is configured to power the second electronics module by controlling an additional flow of power from the power supply or from the energy storage unit to the second electronics module.

The modular control system of any preceding clause, wherein the hydraulics system comprises one or more reservoirs, one or more hydraulic pump units, one or more accumulators, one or more intensifiers, or a combination thereof.

The modular control system of any preceding clause, wherein adjusting operations of the mineral extraction system comprises adjusting operations of a tubing hanger running tool, a test tree, completion equipment, or a combination thereof.

The modular control system of any preceding clause, comprising one or more monitoring devices configured to measure one or more flow parameters, wherein the one or more monitoring devices are communicatively coupled to the first electronics module or the second electronics module.

A mineral extraction system includes a riser configured to extend between an offshore vessel and a wellhead coupled to a mineral deposit, where the riser comprises a blowout preventer comprising an annular sealing device configured to block a flow of fluid exiting the wellhead. The mineral extraction system also includes a modular subsea control system having a first control module positioned within the riser and above the annular sealing device of the blowout preventer, where the first control module includes a first electronics module configured to output and receive one or more control signals, an energy storage unit, and a hydraulics system configured to generate a flow of pressurized fluid. The modular subsea control system also has a second control module positioned within the riser and below the annular sealing device of the blowout preventer. The second control module includes a second electronics module configured to output and receive additional control signals, where the second electronics module is communicatively coupled to the first electronics module, and a plurality of valves configured to adjust operations of the mineral extraction system. The plurality of valves is communicatively coupled to the second electronics module, fluidly coupled to the hydraulics system, and configured to control the flow of the pressurized fluid to adjust operations of the mineral extraction system.

The mineral extraction system of the preceding clause, comprising a topside control system, wherein the topside control system is configured to electrically and communicatively couple to the modular control system via a subsea network.

The mineral extraction system of the preceding clause, wherein the topside control system comprises a controller configured to control a flow of power from a power source to the modular control system via one or more electrical cables of the subsea network.

The mineral extraction system of the preceding clause, wherein the modular subsea control system comprises one or more monitoring devices configured to measure one or more flow parameters, the one or more monitoring devices are communicatively coupled to the first electronics module or the second electronics module, and the controller of the topside control system is configured to: receive, via the subsea network, data indicative of measured values of the one or more flow parameters from the modular control system; and output, via the subsea network, one or more commands to adjust the operations of the mineral extraction system based on the data.

The mineral extraction system of the preceding clause, wherein the one or more monitoring devices comprise one or more flow meters, one or more temperature gauges, one or more pressure gauges, or a combination thereof.

The mineral extraction system of any preceding clause, wherein the hydraulics system comprises one or more reservoirs, one or more hydraulic pump units, one or more accumulators, one or more intensifiers, or a combination thereof.

The mineral extraction system of any preceding clause, wherein the first electronics module is configured to power the second electronics module by controlling a flow of power from the energy storage unit to the second electronics module.

A method of operating a mineral extraction system including detecting one or more parameters of the mineral extraction system via one or more monitoring devices associated with a modular control system positioned within a riser of the mineral extraction system, where the modular control system comprises a first control module positioned at a first location within the riser and a second control module positioned at a second location within the riser. The method also includes adjusting operations of the mineral extraction system based on the one or more parameters by controlling one or more control valves within the second control module to control a flow of pressurized fluid from a hydraulic system within the first control module to one or more actuators of the mineral extraction system.

The method of the preceding clause, wherein the first location is above an annular sealing device of a blowout preventer, and the second location is below the annular sealing device.

The method of any preceding clause, wherein adjusting operations of the mineral extraction system comprises adjusting operations of a tubing hanger running tool, a test tree, completion equipment, or a combination thereof.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A modular control system for a mineral extraction system, comprising:

a first control module configured to be positioned at a first location within a riser of the mineral extraction system, wherein the first control module comprises a first electronics module configured to output and receive control signals, an energy storage unit, and a hydraulics system configured to generate a flow of pressurized fluid, and wherein the first electronics module is configured to charge the energy storage unit by controlling a flow of power from a power supply configured to mount to a host structure associated with the mineral extraction system; and a second control module configured to be positioned at a second location within the riser, wherein the second location is closer to a wellhead of the mineral extraction system than the first location, and wherein the second control module comprises:

a second electronics module configured to output and receive additional control signals, wherein the second electronics module is communicatively coupled to the first electronics module; and a plurality of valves configured to adjust operations of the mineral extraction system, wherein the plurality of valves is communicatively coupled to the second electronics module, the plurality of valves is fluidly coupled to the hydraulics system, and the plurality of valves is configured to control the flow of the pressurized fluid to adjust operations of the mineral extraction system.

2. The modular control system of claim 1, wherein the first electronics module and the second electronics module are communicatively coupled to one another via one or more electric cables, and the hydraulics system is fluidly coupled to the plurality of valves via one or more hydraulic lines.

3. The modular control system of claim 2, comprising a slick joint disposed between the first control module and the second control module, wherein the one or more electric cables and the one or more hydraulic lines extend through one or more longitudinal passages within the slick joint.

4. The modular control system of claim 1, wherein the first location is above an annular sealing device of a blowout preventer, and the second location is below the annular sealing device.

5. The modular control system of claim 1, wherein the first location is below an annular sealing device of a blowout preventer, and the second location is in a space between a first set of rams of the blowout preventer and a second set of rams of the blowout preventer.

6. The modular control system of claim 1, wherein the first electronics module is configured to power the second electronics module by controlling an additional flow of power from the power supply or from the energy storage unit to the second electronics module.

7. The modular control system of claim 1, wherein the hydraulics system comprises one or more reservoirs, one or more hydraulic pump units, one or more accumulators, one or more intensifiers, or a combination thereof.

8. The modular control system of claim 1, wherein adjusting operations of the mineral extraction system comprises adjusting operations of a tubing hanger running tool, a test tree, completion equipment, or a combination thereof.

9. The modular control system of claim 1, comprising one or more monitoring devices configured to measure one or more flow parameters, wherein the one or more monitoring devices are communicatively coupled to the first electronics module or the second electronics module.

10. A mineral extraction system, comprising:

a riser configured to extend between an offshore vessel and a wellhead coupled to a mineral deposit, wherein the riser comprises a blowout preventer comprising an annular sealing device configured to block a flow of fluid exiting the wellhead; and a modular subsea control system, comprising:

a first control module positioned within the riser and above the annular sealing device of the blowout preventer, wherein the first control module comprises a first electronics module configured to output and receive one or more control signals, an energy storage unit, and a hydraulics system configured to generate a flow of pressurized fluid; and a second control module positioned within the riser and below the annular sealing device of the blowout preventer, wherein the second control module comprises:

a second electronics module configured to output and receive additional control signals, wherein the second electronics module is communicatively coupled to the first electronics module, and wherein the first electronics module is configured to power the second electronics module by controlling a flow of power from the energy storage unit to the second electronics module; and a plurality of valves configured to adjust operations of the mineral extraction system, wherein the plurality of valves is communicatively coupled to the second electronics module, the plurality of valves is fluidly coupled to the hydraulics system, and the plurality of valves is configured to control the flow of the pressurized fluid to adjust operations of the mineral extraction system.

11. The mineral extraction system of claim 10, comprising a topside control system, wherein the topside control system is configured to electrically and communicatively couple to the modular control system via a subsea network.

12. The mineral extraction system of claim 11, wherein the topside control system comprises a controller configured to control an additional flow of power from a power source to the modular control system via one or more electrical cables of the subsea network.

13. The mineral extraction system of claim 12, wherein the modular subsea control system comprises one or more monitoring devices configured to measure one or more flow parameters, the one or more monitoring devices are communicatively coupled to the first electronics module or the second electronics module, and the controller of the topside control system is configured to:

receive, via the subsea network, data indicative of measured values of the one or more flow parameters from the modular control system; and output, via the subsea network, one or more commands to adjust the operations of the mineral extraction system based on the data.

14. The mineral extraction system of claim 13, wherein the one or more monitoring devices comprise one or more flow meters, one or more temperature gauges, one or more pressure gauges, or a combination thereof.

15. The mineral extraction system of claim 10, wherein the hydraulics system comprises one or more reservoirs, one or more hydraulic pump units, one or more accumulators, one or more intensifiers, or a combination thereof.

* * * * *